US008749540B2

(12) United States Patent
Lee

(10) Patent No.: US 8,749,540 B2
(45) Date of Patent: Jun. 10, 2014

(54) APPARATUS FOR OUTPUTTING GAMMA FILTER REFERENCE VOLTAGE, DISPLAY APPARATUS, AND METHOD OF DRIVING THE DISPLAY APPARATUS

(75) Inventor: Wook Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 783 days.

(21) Appl. No.: 12/855,641

(22) Filed: Aug. 12, 2010

(65) Prior Publication Data

US 2011/0050676 A1 Mar. 3, 2011

(30) Foreign Application Priority Data

Sep. 2, 2009 (KR) ..... 10-2009-0082563

(51) Int. Cl.
*G09G 5/00* (2006.01)

(52) U.S. Cl.
USPC ..... 345/212; 345/76; 345/98; 345/211; 345/214

(58) Field of Classification Search
USPC ..... 345/76, 98, 211, 212, 214
See application file for complete search history.

(56) References Cited

U.S. PATENT DOCUMENTS

2002/0063666 A1* 5/2002 Kang et al. ..... 345/87
2007/0075957 A1* 4/2007 Chen et al. ..... 345/98
2008/0143656 A1 6/2008 Hasegawa et al.
2009/0079727 A1* 3/2009 Ozawa ..... 345/214
2009/0201231 A1* 8/2009 Takahara et al. ..... 345/76

FOREIGN PATENT DOCUMENTS

JP 2008-151946 A 7/2008
JP 2008-152087 A 7/2008
KR 10-2006-0078751 A1 7/2006
KR 10-2008-0060438 7/2008
KR 10-2008-0060527 7/2008
KR 10-0844774 B1 7/2008
KR 10-2008-0090879 A 10/2008

OTHER PUBLICATIONS

KIPO Registration Determination Certificate dated Oct. 31, 2011, for KR patent application No. 10-2009-0082563, 5 pages.
KIPO Office action dated Mar. 18, 2011, for Korean priority Patent application 10-2009-0082563.

* cited by examiner

*Primary Examiner* — Dwayne Bost
*Assistant Examiner* — Gerald Johnson
(74) *Attorney, Agent, or Firm* — Christie, Parker & Hale, LLP

(57) ABSTRACT

An apparatus for outputting a gamma filter reference voltage, the apparatus including a gamma filter reference voltage generator that generates a first reference voltage to be applied as a reference voltage to a gamma filter and a plurality of second reference voltages, a temperature sensor that generates temperature information by sensing temperature, and a reference voltage adjustment unit that selects at least one of the plurality of second reference voltages based on the temperature information and applies the selected second reference voltage to the gamma filter.

23 Claims, 6 Drawing Sheets

APPARATUS FOR OUTPUTTING GAMMA FILTER REFERENCE VOLTAGE, DISPLAY APPARATUS, AND METHOD OF DRIVING THE DISPLAY APPARATUS

CROSS-REFERENCE TO RELATED PATENT APPLICATION

This application claims priority to and the benefit of Korean Patent Application No. 10-2009-0082563, filed on Sep. 2, 2009, in the Korean Intellectual Property Office, the disclosure of which is incorporated herein in its entirety by reference.

BACKGROUND

1. Field

The present invention relates to an apparatus for outputting a gamma filter reference voltage, a display apparatus, and a method of driving the display apparatus.

2. Description of Related Art

The amount of power consumed in a display apparatus is determined by a driving voltage and a driving current for driving a plurality of pixel circuits each having a driving transistor and a light-emitting device. The driving voltage may be applied to a driving transistor and a light-emitting device, and the driving current may be conducted through the driving transistor and the light-emitting device. The driving transistor supplies the driving current, determined according to a data voltage, to the light-emitting device, and the light-emitting device emits light, the brightness of which depends on the data voltage.

SUMMARY

Embodiments of the present invention provide an apparatus for outputting a gamma filter reference voltage in order to reduce power consumption in a display apparatus, the display apparatus having a gamma filter, and a method of driving the display apparatus. According to embodiments, the display apparatus maintains a temperature margin at a constant level while operating the display apparatus using a reduced or minimum driving voltage.

According to one aspect of the present invention, there is provided n apparatus for outputting a gamma filter reference voltage, the apparatus including a gamma filter reference voltage generator configured to generate a first reference voltage and a plurality of second reference voltages and to apply the first reference voltage to a gamma filter, a temperature sensor configured to generate temperature information by measuring a temperature; and a reference voltage adjustment unit configured to select at least one of the plurality of second reference voltages based on the temperature information and to apply the selected second reference voltage to the gamma filter.

The reference voltage adjustment unit may include a control signal generator configured to generate a reference voltage control signal that is determined according to the temperature information, and a reference voltage selector configured to select the at least one of the plurality of second reference voltages according to the reference voltage control signal, and to apply the selected second reference voltage to the gamma filter. The control signal generator may include a reference voltage information storage unit configured to store the reference voltage control signal determined according to the temperature information, and a control signal output unit configured to detect the reference voltage control signal stored in the reference voltage information storage unit according to the temperature information received from the temperature sensor, and to supply the reference voltage control signal to the reference voltage selector.

The first reference voltage may correspond to a lowest brightness of the gamma filter, and the selected second reference voltages may correspond to a highest brightness of the gamma filter.

The plurality of second reference voltages may include $1^{st}$ to $k^{th}$ second reference voltages, where k is a natural number. A difference between the $1^{st}$ second reference voltage and the first reference voltage may be a minimum value and the difference between the $k^{th}$ second reference voltage and the first reference voltage may be a maximum value from among the $1^{st}$ to $k^{th}$ second reference voltages. The $1^{st}$ second reference voltage may be applied to the gamma filter in a first range of temperatures of a range of driving temperatures. At least one of the $2^{nd}$ to $k^{th}$ second reference voltages may be selected according to the temperature information and may be applied to the gamma filter in a second range of temperatures. The second range of temperatures may be a remaining part of the range of driving temperatures.

The first range of temperatures may be higher than the second range of temperatures.

The reference voltage adjustment unit may individually select the at least one of the plurality of second reference voltages with respect to different colors and may apply the selected second reference voltages to the gamma filter.

According to another aspect of the present invention, there is provided a display apparatus including a plurality of pixel circuits, a data driver including a gamma filter and a gamma filter reference voltage output unit configured to apply reference voltages to the gamma filter, the data driver configured to apply a data voltage to the plurality of pixel circuits, and a scan driver configured to supply a scan signal to the plurality of pixel circuits. The gamma filter reference voltage output unit includes a gamma filter reference voltage generator configured to generate a first reference voltage and a plurality of second reference voltages and to apply the first voltage to the gamma filter, a temperature sensor configured to generate temperature information based on a measured temperature, and a reference voltage adjustment unit configured to select at least one of the plurality of second reference voltages based on the temperature information and to apply the selected second reference voltage to the gamma filter. A difference between an anode driving voltage and a cathode driving voltage applied to the plurality of pixel circuits is determined by a driving margin in a first range of temperatures of a range of driving temperatures. The reference voltage adjustment unit is configured to adjust the selected second reference voltage to be applied to the gamma filter in a second range of temperatures. The second range of temperatures is a remaining part of the range of driving temperatures.

The display apparatus may be an organic light-emitting diode (OLED) display apparatus.

According to another aspect of the present invention, there is provided a method of driving a display apparatus that has a plurality of pixel circuits, the method including generating a first reference voltage to be applied to a gamma filter and a plurality of second reference voltages, generating temperature information by measuring a temperature, selecting at least one of the plurality of second reference voltages based on the temperature information and applying the selected second reference voltage to the gamma filter, determining a difference between an anode driving voltage and a cathode driving voltage applied to the plurality of pixel circuits by a driving margin in a first range of temperatures of a range of driving temperatures, and adjusting the selected second reference voltage to be applied to the gamma filter in a second range of temperatures. The second range of temperatures is the remaining part of a range of driving temperatures.

The display apparatus may be an organic light-emitting diode (OLED) display apparatus.

BRIEF DESCRIPTION OF THE DRAWINGS

Features and aspects of the present invention will become more apparent in the description below which details exemplary embodiments thereof with reference to the attached drawings in which.

DETAILED DESCRIPTION

Hereinafter, exemplary embodiments of the present invention will now be described more fully with reference to the accompanying drawings. This invention may, however, be embodied in many different forms and should not be construed as being limited to the embodiments set forth herein. Rather, these embodiments are provided so that this disclosure will be thorough and complete to fully convey the concept of the invention to those skilled in the art. The specific terms used in the present disclosure are not intended to restrict the scope of the present invention and are only used for a better understanding of (to facilitate the understanding of) the present invention. It will be understood by those skilled in the art that various changes in form and details may be made without departing from the spirit and scope of the invention as defined by the appended claims.

Figure 1:
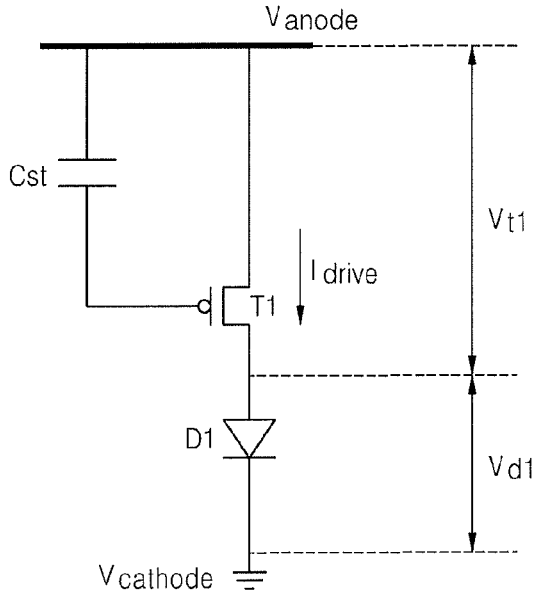
FIG. 1 is a circuit diagram of a pixel circuit including a driving transistor and a light emitting diode according to an embodiment of the present invention.

FIG. 1 is a circuit diagram of a pixel circuit including a driving transistor and a light emitting diode according to an embodiment of the present invention. Referring to FIG. 1, the pixel circuit may include a storage capacitor Cst, a driving transistor T1, and a light-emitting device D1.

The storage capacitor Cst is charged with a data voltage applied to the pixel circuit, stores the data voltage, and applies it to a gate terminal of the driving transistor T1.

The driving transistor T1 generates a driving current $I_{drive}$ from the data voltage applied to the gate terminal of the driving transistor T1 and supplies the driving current $I_{drive}$ to the light-emitting device D1. To this end, an anode driving voltage $V_{anode}$ is applied to a first terminal of the driving transistor T1, and a second terminal of the driving transistor T1 is connected to the light-emitting device D1.

The light-emitting device D1 is supplied the driving current $I_{drive}$ generated by the driving transistor T1, and emits light. A first end of the light-emitting device D1 may be connected to the second terminal of the driving transistor T1 and a cathode driving voltage $V_{cathode}$ may be applied to a second end of the light-emitting device D1. The light-emitting device D1 is a device that emits light and may be embodied as, for example, an organic light-emitting diode (OLED).

Figure 2:
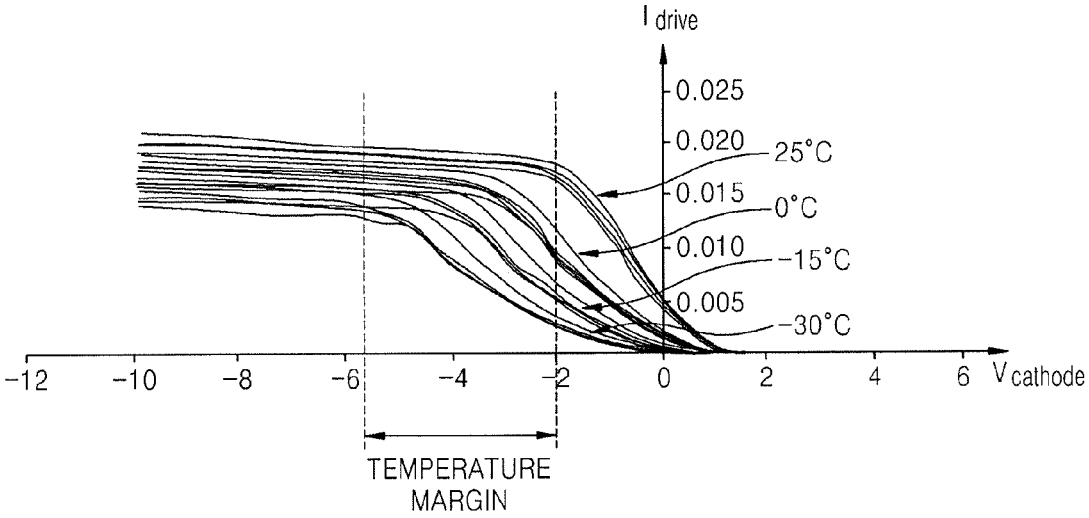
FIG. 2 is a graph showing current-voltage characteristics of a driving transistor according to temperature.

FIG. 2 is a graph showing current-voltage characteristics of a driving transistor according to temperature.

In general, current-voltage characteristics of an OLED vary according to temperature. Such dependence influences the current-voltage characteristics of the driving transistor T1 of FIG. 1 that determine a driving current. Referring to FIG. 1, the light-emitting device D1 and the driving transistor T1 are connected in series, and thus the light-emitting device D1 acts as a load of the driving transistor T1. In this case, if the current-voltage characteristics of the light-emitting device D1 change according to temperature, the voltage drop across the driving transistor T1 is influenced by the change in the current-voltage characteristics of the light-emitting device D1. For example, given the same driving current $I_{drive}$ through the light-emitting device D1, if a reduction in temperature changes the current-voltage characteristics of the light-emitting device D1 such that a voltage drop $V_{d1}$ across the light-emitting device D1 is increased, then the voltage $V_{t1}$, which is the voltage drop across the driving transistor T1, may be reduced. Accordingly, a reduction in temperature results in the driving transistor T1 operating using a greater driving voltage in order to operate in a saturation region.

Referring to FIG. 2, the voltage drop across the driving transistor T1 changes when the current-voltage characteristics of the light-emitting device D1 change according to temperature. According to the graph of FIG. 2, the horizontal axis denotes a cathode driving voltage $V_{cathode}$ and the vertical axis denotes a driving current $I_{drive}$. Referring to FIG. 2, a reduction in temperature results in an increase in a voltage drop $V_{d1}$ across the light-emitting device D1, and thus the cathode driving voltage $V_{cathode}$ for the driving transistor T1 to operate in a saturation region is reduced. In addition, if temperature is reduced from −15° C. to −30° C. when the cathode driving voltage $V_{cathode}$ is −4V, the current-voltage characteristics of the driving transistor T1 are changed, and the driving current $I_{drive}$ supplied from the driving transistor T1 is reduced. Thus, the brightness of light generated by the light-emitting device D1, when the temperature is reduced from −15° C. to −30° C., is lower than when the driving transistor T1 operates in a saturation region. Therefore, the driving voltage is determined so as to guarantee that the driving transistor operates in saturation region. Also, when the voltage drop across the light-emitting device D1 according to temperature varies differently for the different colors (e.g., red (R), green (G), and blue (B)), color temperature of video reproduced in a display apparatus changes. In order to prevent, or reduce, a reduction in brightness and a change in color coordinates due to change in temperature, in a conventional method, a temperature margin is maintained by increasing a driving voltage. However, if the driving voltage is increased in order to maintain a temperature margin, power consumption in the display apparatus increases.

Figure 3:
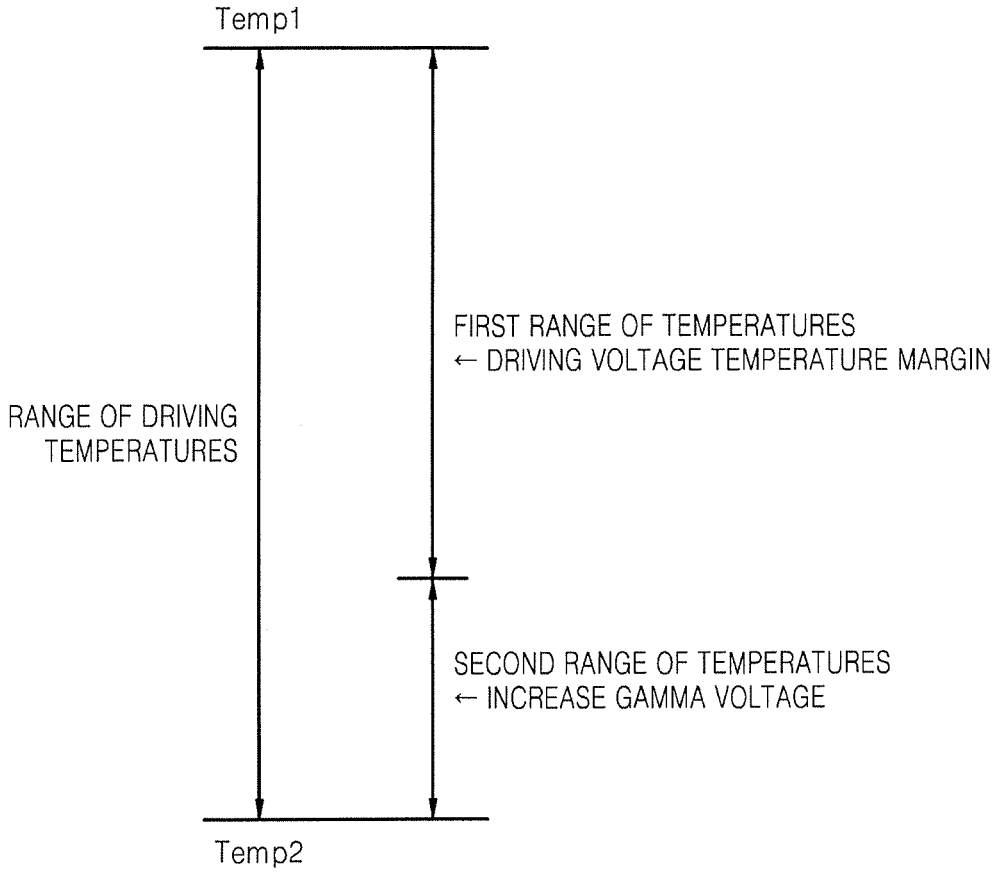
FIG. 3 is a diagram illustrating a method of maintaining a temperature margin according to an embodiment of the present invention.

FIG. 3 is a diagram illustrating a method of maintaining a temperature margin according to an embodiment of the present invention. Referring to FIG. 3, in a range of driving temperatures in which operational performance of a display apparatus is guaranteed, a temperature margin is maintained by a driving voltage only in a first range of temperatures and a gamma voltage is increased overall for a second range of temperatures, that is, the remaining part of the range of driving temperatures. Accordingly, it is possible to not only reduce power consumption by reducing the driving voltage but to also prevent, or reduce, a reduction in brightness and a change in color coordinates.

For example, when the range of driving temperatures ranges from 70° C. to −30° C. and an anode driving voltage $V_{anode}$ and a cathode driving voltage $V_{cathode}$ used to drive a display apparatus in the range of driving temperatures are 4.6V and −6V, respectively, then, according to one embodiment, if the difference between the anode driving voltage $V_{anode}$ and the cathode driving voltage Vcathode, that is, the driving voltage, is reduced, then a problem of a portion of a temperature margin where the reduced driving voltage is insufficient may be solved by adding the gamma voltage. Here, if it is assumed that the driving voltage is reduced by increasing the cathode driving voltage $V_{cathode}$ to −4V, then the operational performance of the display apparatus may be guaranteed by using the driving voltage in the first range of temperatures, e.g., from 70° C. to −15° C. However, brightness may decrease and color temperature may change due to a decrease in the driving voltage in the second range of temperatures, e.g., from −15° C. to −30° C. In order to compensate for the reduction in brightness and the change in color temperature, the gamma voltage is increased according to temperature.

Alternatively, the gamma voltage may be increased individually for the different colors R, G, and B. Since the current-voltage characteristics of the light-emitting device D1 and the driving transistor T1 of FIG. 1, which vary according to temperature, may change differently for the different colors R, G, and B, it is possible to prevent, or reduce, such color temperature change by increasing the gamma voltage individually for the different colors R, G, and B.

Figure 4:
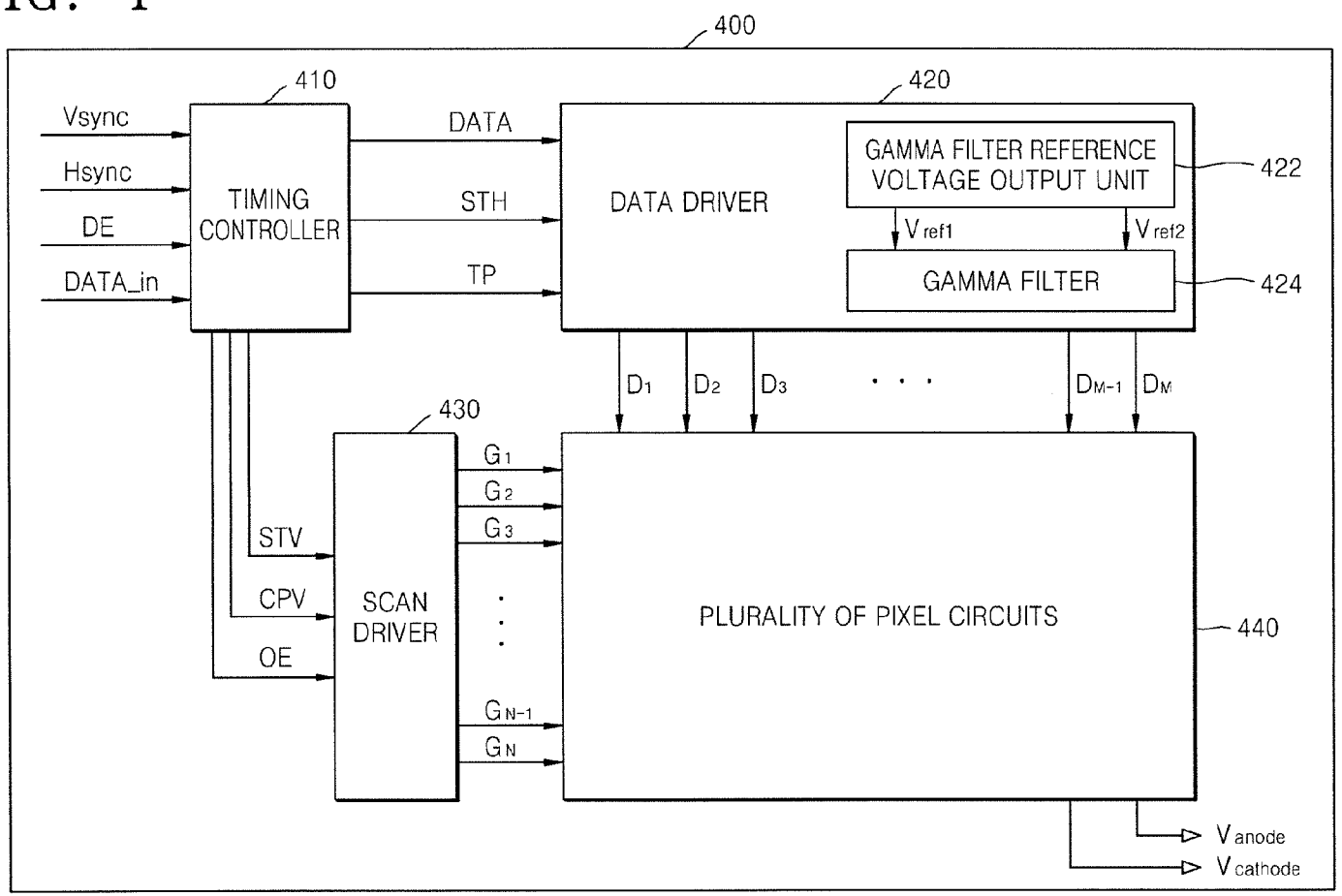
FIG. 4 is a block diagram of a display apparatus according to an embodiment of the present invention.

FIG. 4 is a block diagram of a display apparatus 400 according to an embodiment of the present invention. The display apparatus 400 includes a timing controller 410, a data driver 420, a scan driver 430, and a plurality of pixel circuits 440.

The timing controller 410 receives a vertical synchronization signal Vsync, a horizontal synchronization signal Hsync, a data enable signal DE, and a video data signal DATA_in, and outputs an RGB data signal DATA converted from the video data signal DATA_in to the data driver 420 according to the specifications of the data driver 420. The timing controller 410 may also generate a horizontal synchronization starting signal STH and a load signal TP and output them to the data driver 420. The horizontal synchronization starting signal STH provides reference timing for outputting a plurality of data voltages $D_1, D_2, \ldots,$ to $D_M$ from the data driver 420 to the plurality of pixel circuits 440.

Also, the timing controller 410 may output a vertical synchronization starting signal STV, a gate clock signal CPV, and an output enable signal OE to the scan driver 430. The vertical synchronization starting signal STV is used to select a first scan line, the gate clock signal CPV is used to select a plurality of gate lines sequentially, and the output enable signal OE controls an output of the scan driver 430.

In one embodiment, the data driver 420 includes a plurality of data driver integrated circuits (ICs). The data driver 420 receives the RGB data signal DATA and control signals STH and TP from the timing controller 410, generates the data voltages $D_1, D_2, \ldots,$ to $D_M$ for respective data voltage channels, and then supplies the data voltages $D_1, D_2, \ldots,$ to $D_M$ to the pixel circuits 440.

The data driver 420 includes a gamma filter reference voltage output unit 422 and a gamma filter 424.

The gamma filter reference voltage output unit 422 generates at least one reference voltage, e.g., reference voltages Vref1 and Vref2, for the gamma filter 424 to generate a plurality of gamma voltages, and then supplies the reference voltages Vref1 and Vref2 to the gamma filter 424. According to an embodiment of the present invention, the reference voltages Vref1 and Vref2 output from the gamma filter reference voltage output unit 422 are determined according to temperature information.

The gamma filter 424 generates the plurality of gamma voltages and applies them to a digital-to-analog converter (not shown) of the data driver 420. According to an embodiment of the present invention, the gamma filter reference voltage output unit 422 generates the reference voltages Vref1 and Vref2 according to the temperature information, and thus, the plurality of gamma voltages generated by the gamma filter 424 also vary according to the temperature information.

In one embodiment, the scan driver 430 includes a plurality of scan driver ICs (not shown). The scan driver 430 scans respective scan lines of the plurality of pixel circuits 440 sequentially by supplying a plurality of scan signals $G_1, G_2, \ldots,$ to $G_N$ to the scan lines according to the control signals CPV, STV, and OE received from the timing controller 410.

The plurality of pixel circuits 440 are driven using the scan signals $G_1, G_2, \ldots,$ to $G_N$ and the data voltages $D_1, D_2, \ldots,$ to $D_M$, and emit light according to the data voltages $D_1, D_2, \ldots,$ to $D_M$. The plurality of pixel circuits 440 may be arranged, for example, in an M×N two-dimensional (2D) matrix, where M and N are natural numbers. The plurality of pixel circuits 440 may include OLEDs. In several embodiments, for example, each of the plurality of pixel circuits 440 may be constructed as illustrated in FIG. 1.

An anode driving voltage $V_{anode}$ and a cathode driving voltage $V_{cathode}$ are applied to the plurality of pixel circuits 440. According to an embodiment of the present invention, a driving voltage, that is, the difference between the anode driving voltage $V_{anode}$ and the cathode driving voltage $V_{cathode}$, is controlled such that the operational performance of a display apparatus is guaranteed to be in the first range of temperatures of the range of driving temperatures illustrated in FIG. 3.

Figure 5:
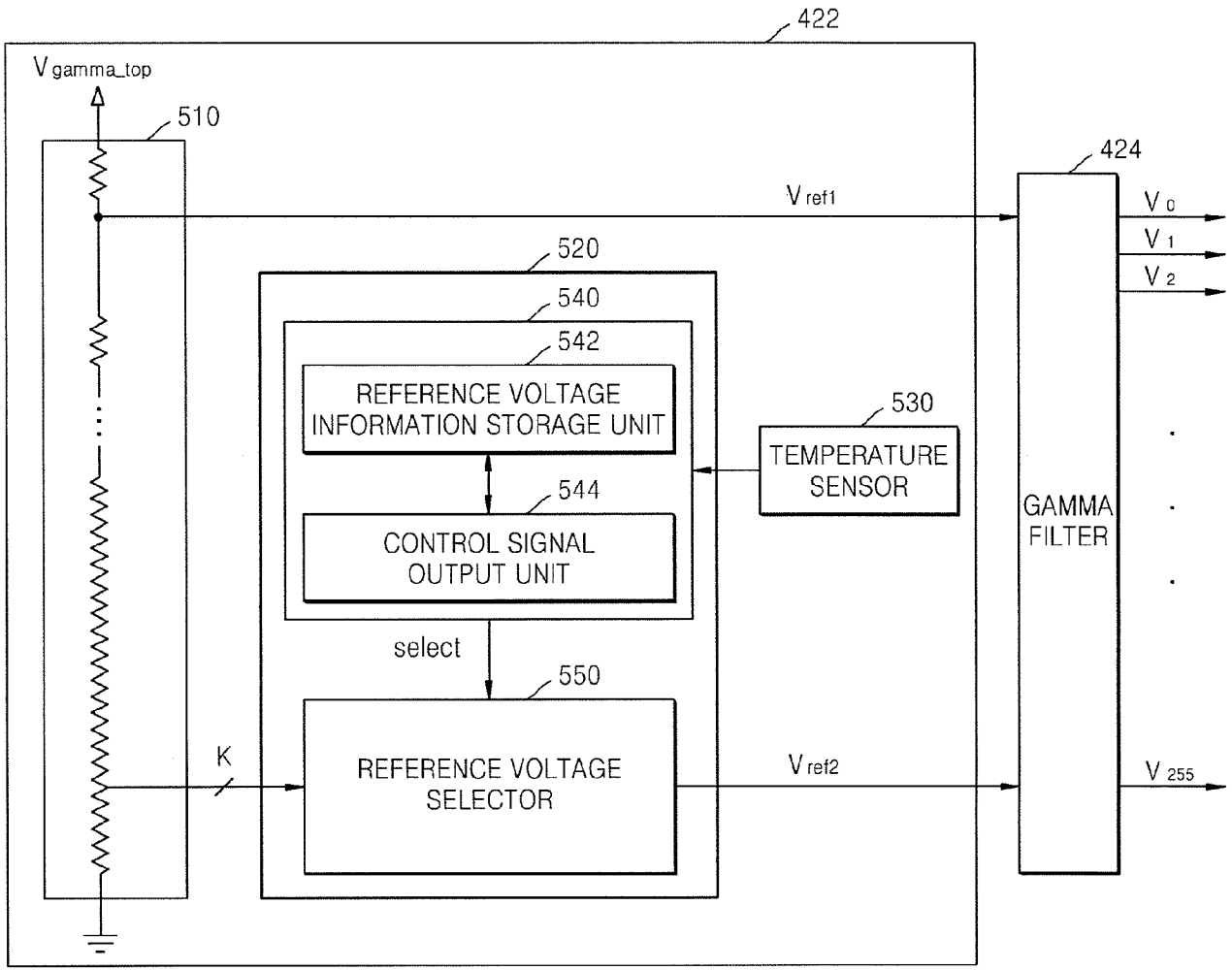
FIG. 5 is a block diagram illustrating in detail the structures of a gamma filter reference voltage output unit and a gamma filter that are included in the display device of FIG. 4, according to an embodiment of the present invention.

FIG. 5 is a block diagram illustrating in detail the structures of the gamma filter reference voltage output unit 422 and the gamma filter 424 included in the display apparatus 400 of FIG. 4, according to an embodiment of the present invention. The gamma filter reference voltage output unit 422 may include a gamma filter reference voltage generator 510, a reference voltage adjustment unit 520, and a temperature sensor 530.

The gamma filter reference voltage generator 510 generates a first reference voltage $V_{ref1}$ and a plurality of second reference voltages $V_{ref2}$ from a gamma filter driving voltage $V_{gamma_top}$. The first reference voltage $V_{ref1}$ and the plurality of second reference voltages $V_{ref2}$ may be generated using a voltage divider coupled to the gamma filter driving voltage $V_{gamma_top}$. The plurality of second reference voltages $V_{ref2}$ are reference voltages corresponding to a plurality of temperatures. The first reference voltage $V_{ref1}$ is applied to the gamma filter 424 and the plurality of second reference voltages $V_{ref2}$ are applied to the reference voltage adjustment unit 520.

The temperature sensor 530 senses the ambient temperature of an environment in which a display apparatus operates and outputs temperature information. The type of the temperature sensor 530 is not limited provided it can measure temperature and output temperature information.

The reference voltage adjustment unit 520 selects at least one of the plurality of second reference voltages $V_{ref2}$, which is received from the gamma filter reference voltage generator 510, according to the temperature information received from the temperature sensor 530, and then applies the selected second reference voltage $V_{ref2}$ to the gamma filter 424.

According to an embodiment of the present invention, the reference voltage adjustment unit 520 may include a control signal generator 540 and a reference voltage selector 550. The control signal generator 540 generates a control signal select for controlling the reference voltage selector 550 according to the temperature information received from the temperature sensor 530 and then supplies the control signal select to the reference voltage selector 550. In this case, the control signal select is determined based on the temperature information, and is used by the reference voltage selector 550 to select at least one of the plurality of second reference voltages $V_{ref2}$ and to supply the selected second reference voltage $V_{ref2}$ to the gamma filter 424.

According to an embodiment of the present invention, the reference voltage adjustment unit 520 may include a reference voltage information storage unit 542 and a control signal output unit 544.

The reference voltage information storage unit 542 stores the control signal select determined according to the temperature information. The control signal select may be maintained at a constant level in the range of first temperature of FIG. 3 and may be varied according to temperature in the second range of temperatures of FIG. 3.

The control signal output unit 544 searches the reference voltage information storage unit 542 for the control signal select corresponding to the temperature information, which is received from the temperature sensor 530, and supplies the control signal select to the reference voltage selector 550.

The reference voltage selector 550 selects at least one of the plurality of second reference voltages $V_{ref2}$ according to the control signal select and supplies the selected second reference voltage Vref2 to the gamma filter 424. For example, in one embodiment, the reference voltage selector 550 may be a multiplexer (MUX).

The second reference voltage $V_{ref2}$ may be approximately equal to a gamma voltage corresponding to the highest brightness of the gamma filter 424. Also, in the second range of temperatures, the control signal select and the plurality of second reference voltages $V_{ref2}$ are set such that the lower the temperature, the greater the difference between the first reference voltage $V_{ref1}$ and the second reference voltage $V_{ref2}$ applied to the gamma filter 424. If the driving transistor T1 of each of the plurality of pixel circuits 440 of FIG. 1 is a P-type transistor, in the second range of temperatures (see FIG. 3), the lower the temperature, the lower the second reference voltage $V_{ref2}$ applied to the gamma filter 424. However, if the driving transistor T1 of each of the plurality of pixel circuits 440 of FIG. 1 is an N-type transistor, in the second range of temperatures (see FIG. 3), the lower the temperature, the higher the second reference voltage $V_{ref2}$ applied to the gamma filter 424.

The gamma filter 424 receives the first reference voltage $V_{ref1}$ and the second reference voltage $V_{ref2}$ from the gamma filter reference voltage output unit 422, and generates and outputs a plurality of gamma voltages $V_0, V_1, V_2, \ldots$, to $V_{255}$. The total number of gamma voltages depends on the total number of gray levels that the display apparatus 400 of FIG. 4 supports. For example, if the display apparatus 400 supports 256 brightness levels, the gamma filter 424 generates and outputs the 256 gamma voltages $V_0, V_1, V_2, \ldots$, to $V_{255}$.

The gamma filter reference voltage output unit 422 may set the first and second reference voltages $V_{ref1}$ and $V_{ref2}$ differently for each of the different colors that the display supports (e.g., R, G, and B) and may adjust the second reference voltages $V_{ref2}$ differently for each of the different colors R, G, and B in the second range of temperatures. The current-voltage characteristics of the light-emitting device D1 and the driving transistor T1 that vary with temperature may change differently for each of the different colors R, G, and B. Thus, if the second reference voltages $V_{ref2}$ are set differently for each of the different colors R, G, and B, it is possible to prevent, or reduce, the color temperature of a video displayed on the display apparatus 400 from varying according to the driving temperature.

According to an embodiment of the present invention, in order to respectively adjust the second reference voltages Vref2 differently for each of the different colors R, G, and B, the gamma filter reference voltage generator 510 generates the second reference voltages $V_{ref2}$ for each of the different colors R, G, and B, and then the second reference voltages $V_{ref2}$ are applied to the gamma filter 424. According to another embodiment of the present invention, in order to individually adjust the second reference voltages Vref2 for each of the different colors R, G, and B, the reference voltage information storage unit 542 stores control signals select for the different colors R, G, and B, the control signal output unit 544 individually supplies the control signals select to the reference voltage selector 550 for the different colors R, G, and B, and the reference voltage selector 550 separately outputs the selected second reference voltages $V_{ref2}$ to the gamma filter 424 for the different colors R, G and B. The control signal output unit 544 supplies the control signals select to the reference voltage selector 550, and the reference voltage selector 550 applies the selected second reference voltages $V_{ref2}$ to the gamma filter 424.

Figure 6:
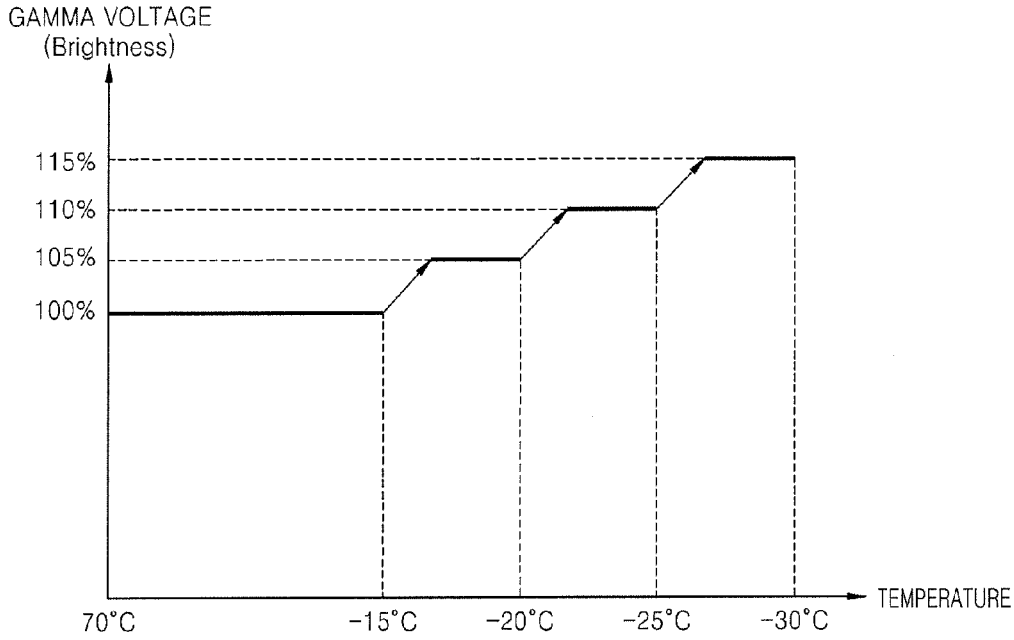
FIG. 6 is a graph showing variations in a plurality of gamma voltages versus time according to an embodiment of the present invention.

FIG. 6 is a graph showing variations in a plurality of gamma voltages versus time according to an embodiment of the present invention. According to an embodiment of the present invention, a plurality of gamma voltages $V_0, V_1, V_2, \ldots$, to $V_{255}$ are not adjusted in the first range of temperatures of FIG. 3 and are adjusted in the second range of temperatures of FIG. 3. Referring to FIG. 6, in the second range of temperatures, as temperature decreases, the gamma voltages $V_0, V_1, V_2, \ldots$, to $V_{255}$ are adjusted to increase brightness. That is, in the second range of temperatures, if the driving transistor T1 of each of the plurality of pixel circuits 440 is a P-type transistor, the gamma voltages $V_0, V_1, V_2, \ldots$, to $V_{255}$ are lowered as temperature decreases, and if the driving transistor T1 of each of the plurality of pixel circuits 440 is an N-type transistor, the gamma voltages $V_0, V_1, V_2, \ldots$, to $V_{255}$ are increased as temperature decreases.

Figure 7:
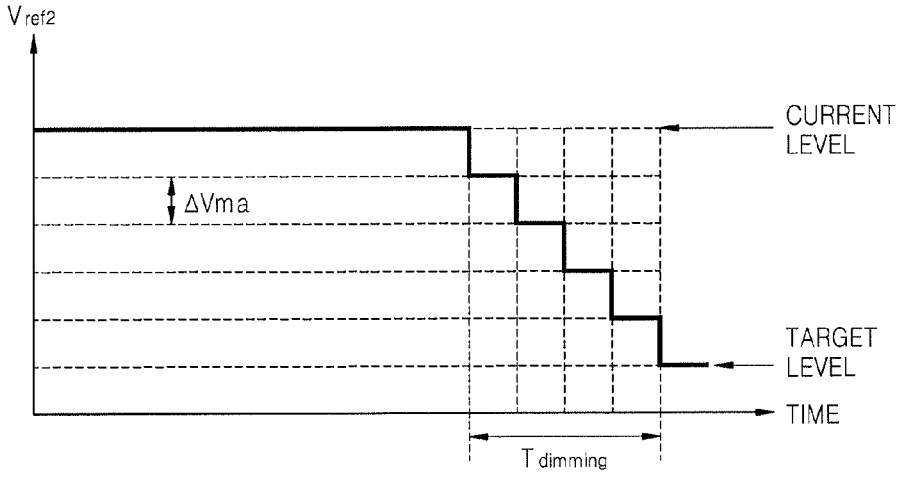
FIG. 7 is a graph showing a method of controlling a second reference voltage according to an embodiment of the present invention.

FIG. 7 is a graph showing a method of controlling a second reference voltage $V_{ref2}$ according to an embodiment of the present invention. Referring to FIG. 7, when temperature at which the display apparatus 400 of FIG. 4 operates changes to fall within the second range of temperatures, the second reference voltage $V_{ref2}$ is gradually adjusted over a time period (e.g., a predetermined time period) for reference voltage adjustment $T_{dimming}$ in order to change the second reference voltage $V_{ref2}$ from a current level to a target level. For example, if a number x of operations taken to adjust the second reference voltage $V_{ref2}$ over the time period $T_{dimming}$ is predetermined, a temperature change is sensed, and if the second reference voltage $V_{ref2}$ needs to be adjusted, then a variation $\Delta V_{ma}$ of the second reference voltage $V_{ref2}$ in each of the operations may be calculated by dividing the total number of second reference voltages $V_{ref2}$ between a current value and a target value by the number x, which may be predetermined, and the second reference voltage $V_{ref2}$ may be gradually changed by the variation $\Delta V_{ma}$ in each of the operations over the predetermined time period $T_{dimming}$. To this end, the control signal output unit 544 of FIG. 5 may output a plurality of control signals select in order to gradually change the second reference voltage $V_{ref2}$.

Figure 8:
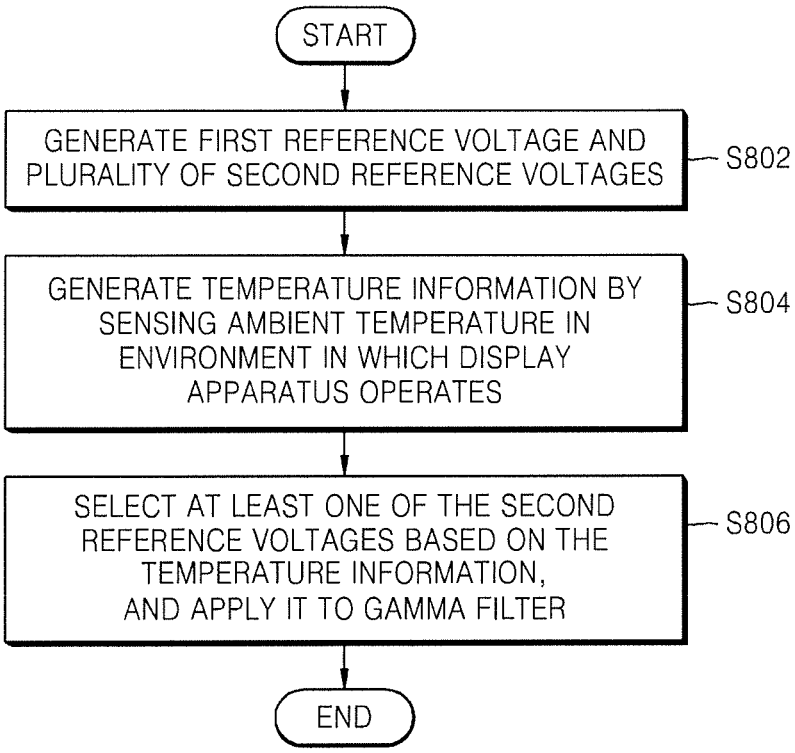
FIG. 8 is a flowchart illustrating a method of driving a display apparatus according to an embodiment of the present invention.

FIG. 8 is a flowchart illustrating a method of driving the display apparatus 400 of FIG. 4 according to an embodiment of the present invention. In the method according to the current embodiment, first, a first reference voltage $V_{ref1}$ and a plurality of second reference voltages $V_{ref2}$ that may be applied to the gamma filter 424 are generated (operation S802).

Next, temperature information is generated by sensing the ambient temperature in an environment in which the display apparatus 400 operates (operation S804). Next, at least one of the plurality of second reference voltages $V_{ref2}$ is selected based on the temperature information and the selected second reference voltage is then applied to the gamma filter 424 (operation S806).

In the current embodiment, the difference between an anode driving voltage $V_{anode}$ and a cathode driving voltage $V_{cathode}$ applied to the plurality of pixel circuits 440 falls within the driving margin in the first range of temperatures, and the reference voltage adjustment unit 520 of FIG. 5 adjusts the second reference voltage $V_{ref2}$ to be applied to the gamma filter 424 in the second range of temperatures.

Alternatively, in operation S806, if the ambient temperature of the environment in which the display apparatus 400 operates changes to fall within the second range of temperatures, then the second reference voltage $V_{ref2}$ may be gradually adjusted over a time period (e.g., predetermined time period) of reference voltage adjustment $T_{dimming}$ in order to change the second reference voltage $V_{ref2}$ from a current level to a target level.

According to the above embodiments of the present invention, it is possible to reduce power consumption while maintaining a temperature margin of a display apparatus having a reduced driving voltage that is to be applied to the display apparatus by increasing a gamma voltage in a range of low temperatures.

While the present invention has been particularly shown and described with reference to exemplary embodiments thereof, it will be understood by those of ordinary skill in the art that various changes in form and details may be made therein without departing from the spirit and scope of the present invention as defined by the following claims and their equivalents.

What is claimed is:

1. An apparatus for outputting a gamma filter reference voltage that has a plurality of pixel circuits, the apparatus comprising:

a gamma filter reference voltage generator configured to generate a first reference voltage and a plurality of second reference voltages and to apply the first reference voltage to a gamma filter;

a temperature sensor configured to generate temperature information based on a measured temperature; and a reference voltage adjustment unit configured to select at least one of the plurality of second reference voltages based on the temperature information, and to apply the selected second reference voltage to the gamma filter, wherein a difference between an anode driving voltage and a cathode driving voltage applied to the plurality of pixel circuits is configured to be adjusted according to the temperature information in a first range of temperatures of a range of driving temperatures, and wherein the reference voltage adjustment unit is configured to select the at least one of the plurality of second reference voltages according to the temperature information in a second range of temperatures, wherein the second range of temperatures is a remaining part of the range of driving temperatures.

2. The apparatus of claim 1, wherein the reference voltage adjustment unit comprises:

a control signal generator configured to generate a reference voltage control signal that is determined according to the temperature information; and a reference voltage selector configured to select the at least one of the plurality of second reference voltages according to the reference voltage control signal and to apply the selected second reference voltage to the gamma filter.

3. The apparatus of claim 2, wherein the control signal generator comprises:

a reference voltage information storage unit configured to store the reference voltage control signal determined according to the temperature information; and a control signal output unit configured to find the reference voltage control signal stored in the reference voltage information storage unit according to the temperature information received from the temperature sensor, and to supply the reference voltage control signal to the reference voltage selector.

4. The apparatus of claim 1, wherein the first reference voltage is equal to a gamma voltage corresponding to a lowest brightness of the gamma filter, and the selected second reference voltage is equal to a gamma voltage corresponding to a highest brightness of the gamma filter.

5. The apparatus of claim 1, wherein:

the plurality of second reference voltages comprises $1^{st}$ to $k^{th}$ second reference voltages, where k is a natural number;

a difference between the $1^{st}$ second reference voltage and the first reference voltage is a minimum value and the difference between the $k^{th}$ second reference voltage and the first reference voltage is a maximum value from among the $1^{st}$ to $k^{th}$ second reference voltages;

the $1^{st}$ second reference voltage is applied to the gamma filter in the first range of temperatures of the range of driving temperatures; and at least one of the $2^{nd}$ to $k^{th}$ second reference voltages is selected according to the temperature information and is applied to the gamma filter in the second range of temperatures, wherein the second range of temperatures is the remaining part of the range of driving temperatures.

6. The apparatus of claim 5, wherein the first range of temperatures is higher than the second range of temperatures.

7. The apparatus of claim 1, wherein, when the selected second reference voltage is to be adjusted due to a change in the temperature information, the reference voltage adjustment unit adjusts the selected second reference voltage gradually from a current level to a target level over a time period for reference voltage adjustment.

8. The apparatus of claim 1, wherein the reference voltage adjustment unit individually selects the at least one of the plurality of second reference voltages with respect to different colors and applies the selected second reference voltages to the gamma filter.

9. A display apparatus comprises:

a plurality of pixel circuits;

a data driver comprising a gamma filter and a gamma filter reference voltage output unit configured to apply reference voltages to the gamma filter, the data driver configured to apply a data voltage to the plurality of pixel circuits; and a scan driver configured to supply a scan signal to the plurality of pixel circuits, wherein the gamma filter reference voltage output unit comprises:

a gamma filter reference voltage generator configured to generate a first reference voltage and a plurality of second reference voltages and to apply the first reference voltage to a gamma filter;

a temperature sensor configured to generate temperature information based on a measured temperature; and a reference voltage adjustment unit configured to select at least one of the plurality of second reference voltages based on the temperature information, and to apply the selected second reference voltage to the gamma filter, and wherein a difference between an anode driving voltage and a cathode driving voltage applied to the plurality of pixel circuits is configured to be adjusted according to the temperature information in a first range of temperatures of a range of driving temperatures, and wherein the reference voltage adjustment unit is configured to select the at least one of the plurality of second reference voltages according to the temperature information in a second range of temperatures, wherein the second range of temperatures is a remaining part of the range of driving temperatures.

10. The display apparatus of claim 9, wherein the reference voltage adjustment unit comprises:

a control signal generator configured to generate a reference voltage control signal that is determined according to the temperature information; and a reference voltage selector configured to select the at least one of the plurality of second reference voltages according to the reference voltage control signal, and to apply the selected second reference voltage to the gamma filter.

11. The display apparatus of claim 10, wherein the control signal generator comprises:

a reference voltage information storage unit configured to store the reference voltage control signal determined according to the temperature information; and a control signal output unit configured to find the reference voltage control signal stored in the reference voltage information storage unit according to the temperature information received from the temperature sensor, and to supply the reference voltage control signal to the reference voltage selector.

12. The display apparatus of claim 9, wherein the first reference voltage is equal to a gamma voltage corresponding to a lowest brightness of the gamma filter, and the selected second reference voltage is equal to a gamma voltage corresponding to a highest brightness of the gamma filter.

13. The display apparatus of claim 9, wherein:

the plurality of second reference voltages comprises $1^{st}$ to $k^{th}$ second reference voltages, where k is a natural number;

a difference between the $1^{st}$ second reference voltage and the first reference voltage is a minimum value and the difference between the $k^{th}$ second reference voltage and the first reference voltage is a maximum value from among the $1^{st}$ to $k^{th}$ second reference voltages;

the $1^{st}$ second reference voltage is applied to the gamma filter in the first range of temperatures of the range of driving temperatures; and at least one of the $2^{nd}$ to $k^{th}$ second reference voltages is selected according to the temperature information and is applied to the gamma filter in the second range of temperatures.

14. The display apparatus of claim 9, wherein the first range of temperatures is higher than the second range of temperatures.

15. The display apparatus of claim 9, wherein, when the selected second reference voltage is to be adjusted due to a change in the temperature information, the reference voltage adjustment unit adjusts the selected second reference voltage gradually from a current level to a target level over a time period for reference voltage adjustment.

16. The display apparatus of claim 9, wherein the display apparatus is an organic light-emitting diode (OLED) display apparatus.

17. The display apparatus of claim 9, wherein the reference voltage adjustment unit individually selects the at least one of the plurality of second reference voltages with respect to different colors and applies the selected second reference voltages to the gamma filter.

18. A method of driving a display apparatus that has a plurality of pixel circuits, the method comprising:

generating a first reference voltage to be applied to a gamma filter and a plurality of second reference voltages;

generating temperature information by measuring a temperature; and selecting at least one of the plurality of second reference voltages based on the temperature information and applying the selected second reference voltage to the gamma filter;

wherein a difference between an anode driving voltage and a cathode driving voltage applied to the plurality of pixel circuits is adjusted according to the temperature information in a first range of temperatures of a range of driving temperatures, and wherein the selecting of the at least one of the plurality of second reference voltages comprises selecting the at least one of the plurality of second reference voltages according to the temperature information in a second range of temperatures, wherein the second range of temperatures is a remaining part of the range of driving temperatures.

19. The method of claim 18, wherein the first reference voltage is equal to a gamma voltage corresponding to a lowest brightness of the gamma filter, and the selected second reference voltage is equal to a gamma voltage corresponding to a highest brightness of the gamma filter.

20. The method of claim 18, wherein:

the plurality of second reference voltages comprises $1^{st}$ to $k^{th}$ second reference voltages, where k is a natural number, a difference between the $1^{st}$ second reference voltage and the first reference voltage is a minimum value and the difference between the $k^{th}$ second reference voltage and the first reference voltage is a maximum value from among the $1^{st}$ to $k^{th}$ second reference voltages, the $1^{st}$ second reference voltage is applied to the gamma filter in the first range of temperatures, and at least one of the $2^{nd}$ to $k^{th}$ second reference voltages is selected according to the temperature information and is applied to the gamma filter in the second range of temperatures.

21. The method of claim 18, wherein the first range of temperatures is higher than the second range of temperatures.

22. The method of claim 18, wherein, when the selected second reference voltage is to be adjusted due to a change in the temperature information, the applying of the second reference voltage comprises adjusting the selected second reference voltage gradually from a current level to a target level over a time period for reference voltage adjustment.

23. The method of claim 18, wherein the display apparatus is an organic light-emitting diode (OLED) display apparatus.

* * * * *